US007739812B2

(12) United States Patent
Wijma

(10) Patent No.: US 7,739,812 B2
(45) Date of Patent: Jun. 22, 2010

(54) CUTTER HEAD AND SUCTION DREDGER

(75) Inventor: Klaas Geert Wijma, Haarlem (NL)

(73) Assignee: Vosta LMG B.V., Amsterdam (NL)

( * ) Notice: Subject to any disclaimer, the term of this patent is extended or adjusted under 35 U.S.C. 154(b) by 0 days.

(21) Appl. No.: 12/280,902

(22) PCT Filed: Feb. 28, 2007

(86) PCT No.: PCT/NL2007/050081

§ 371 (c)(1),
(2), (4) Date: Nov. 6, 2008

(87) PCT Pub. No.: WO2007/100250

PCT Pub. Date: Sep. 7, 2007

(65) Prior Publication Data

US 2009/0133295 A1 May 28, 2009

(30) Foreign Application Priority Data

Feb. 28, 2006 (NL) ..... 1031253

(51) Int. Cl.
*E02F 3/08* (2006.01)

(52) U.S. Cl. ..... 37/337; 37/324; 37/343; 299/87.1

(58) Field of Classification Search ..... 37/337, 37/342, 324, 326, 327; 299/87.1, 75
See application file for complete search history.

(56) References Cited

U.S. PATENT DOCUMENTS 222,380 A * 12/1879 Chaquette ..... 37/326
306,368 A * 10/1884 Von Schmidt ..... 37/327
365,140 A * 6/1887 Lynch ..... 37/327
467,607 A * 1/1892 Humphreys ..... 37/327
526,514 A * 9/1894 Bates ..... 37/327
637,831 A * 11/1899 Robinson ..... 37/327
682,024 A * 9/1901 Bradley ..... 37/327
727,691 A * 5/1903 Robinson ..... 37/327
977,901 A * 12/1910 Robinson ..... 37/325
1,226,386 A * 5/1917 Sackett ..... 37/328
1,436,015 A * 11/1922 Cushing ..... 37/327
1,840,025 A * 1/1932 Daniels ..... 37/327

(Continued)

FOREIGN PATENT DOCUMENTS

DE 2741097 * 3/1978

(Continued)

*Primary Examiner*—Thomas A Beach
(74) *Attorney, Agent, or Firm*—The Webb Law Firm

(57) ABSTRACT

A cutter head for a cutter suction dredger to be mounted rotatably about a cutter head center axis with respect to a suction device for sucking up material cut loose by the cutter head from the bottom of a body of water, which cutter head includes a base ring, a boss spaced from the base ring in the direction of the center axis, and a plurality of arms which extend from the base ring to the boss and are distributed at regular intervals in the peripheral direction, each arm has a series of teeth located on the radially outermost parts of the arm and directed outwards at an angle with respect to the peripheral direction, the direction of rotation of the cutter head being set such that the teeth perform a cutting movement, with non-return mechanisms, preventing movement of cut material from the center axis to the exterior.

12 Claims, 4 Drawing Sheets

U.S. PATENT DOCUMENTS

| | | | | | |
|---|---|---|---|---|---|
| 2,029,816 | A | * | 2/1936 | Ewing | 37/327 |
| 2,040,303 | A | * | 5/1936 | Gaylord | 37/327 |
| 2,090,790 | A | * | 8/1937 | Fray | 37/327 |
| 2,103,124 | A | * | 12/1937 | Stires | 37/328 |
| 2,233,943 | A | * | 3/1941 | Gaylord | 37/328 |
| 2,340,216 | A | * | 1/1944 | Gill | 37/331 |
| 2,370,430 | A | * | 2/1945 | Waldeck | 37/331 |
| 2,702,437 | A | * | 2/1955 | Cushing | 37/327 |
| 2,999,324 | A | * | 9/1961 | Ohlhausen | 37/327 |
| 3,760,518 | A | * | 9/1973 | Hamm | 37/328 |
| 3,807,066 | A | * | 4/1974 | Proehl | 37/327 |
| 3,808,716 | A | * | 5/1974 | Verbeek | 37/328 |
| 4,050,170 | A | * | 9/1977 | Proehl | 37/328 |
| 4,135,318 | A | * | 1/1979 | Volbeda | 37/327 |
| 4,319,415 | A | * | 3/1982 | Mayerbock et al. | 37/328 |
| 4,327,507 | A | * | 5/1982 | Volbeda | 37/323 |
| 4,365,427 | A | * | 12/1982 | Chapman, Jr. | 37/327 |
| 4,373,277 | A | | 2/1983 | Cucheran | |
| 4,403,428 | A | * | 9/1983 | Chapman, Jr. et al. | 37/319 |
| 4,470,210 | A | * | 9/1984 | Hahn | 37/328 |
| 4,702,024 | A | | 10/1987 | Shiba et al. | |
| 4,986,011 | A | * | 1/1991 | van Hemmen et al. | 37/458 |
| 5,617,654 | A | * | 4/1997 | Wetta, II | 37/326 |
| 6,578,294 | B2 | * | 6/2003 | Ollinger, IV | 37/327 |
| 6,729,052 | B2 | * | 5/2004 | Ollinger et al. | 37/452 |

FOREIGN PATENT DOCUMENTS

| | | | | |
|---|---|---|---|---|
| EP | 1522636 | | * | 4/2005 |
| GB | 2032492 | A | * | 5/1980 |
| JP | 2243829 | A | | 9/1990 |
| JP | 06065947 | A | * | 3/1994 |
| NL | 1012795 | C2 | | 2/2001 |
| WO | WO 2006089866 | | * | 8/2006 |

* cited by examiner

CUTTER HEAD AND SUCTION DREDGER

The invention relates to a cutter head for a cutter suction dredger intended to be mounted rotatably about a cutter head center axis with respect to a suction device for sucking up material which has been cut loose by the cutter head from the bottom of a body of water, which cutter head comprises a base ring, a core located at a distance from the base ring in the direction of the center axis, as well as a plurality of arms which extend from the base ring to the core, each of which arms has a series of teeth located on the radially outermost parts of the arm and directed outwards at an angle with respect to the peripheral direction, the direction of rotation of the cutter head being set in such a manner that the teeth perform a cutting movement.

A cutter head of this type is known, and is used in those circumstances in which material can be cut from the bottom of a body of water. For this purpose, the cutter head is provided with cutting teeth, which are attached to the cutter head by means of a replaceable holder system. Depending on the ground material which is being processed, the teeth are subject to considerable wear. After some time, the teeth are consequently no longer suitable for cutting ground material, so that they have to be replaced.

The cut ground material is sucked into the suction device via the interior of the cutter head, in particular into the suction pipe thereof, after which it eventually lands in the bin of the cutter suction dredger. In this connection, the efficiency of the cutter head is important. The efficiency relates to the ratio of the amount of ground material which has been cut loose and the amount of ground material which is eventually obtained. During this process, it is inevitable that losses occur, which is due, inter alia, to the centrifugal forces which are generated by the rotating cutter head. These centrifugal forces cause part of the cut ground material to be flung away outwards, as a result of which it cannot be sucked up by the suction device.

Even ground material which is already inside the cutter head can then still be lost via the openings between the arms. In addition, depending on the position of the cutter head, the cut ground material may slide off to lowerlying parts of the bottom, simply on account of the force of gravity. The U.S. Pat. No. 4,702,024 proposes a solution which is supposed to prevent such spillage. To this end, special shovel panels are provided on the side of the base ring of the cutter head, which are intended to guide the cut ground material up to the suction mouth of the suction device. However, as these shovel panels only extend over a limited height, it is not possible to prevent ground material from still escaping from the cutter head before it reaches the suction mouth.

Netherlands patent 1,012,795 also proposes a solution in order to limit spillage in a cutter suction dredger. According to this solution, the mouth of the suction tube is brought as close as possible to the interior space of the cutter head, in such a manner that the risk of the ground material escaping is reduced. In this connection, it has been proposed to fit the electric motor which drives the cutter head around the suction tube. However, this solution cannot prevent ground material from escaping from the openings between the arms, in particular on account of the centrifugal forces which occur during rotation of the cutter head.

Furthermore, it has been proposed to limit spillage by increasing the suction power of the suction device. This would result in a stronger sucking action at the location of the suction mouth in such a manner that the risk of the cut ground material escaping is reduced. However, the drawback of such a proposal is that the wear of the suction device at increased levels of suction power increases rapidly, in particular as a result of the strong abrasive action of the ground material.

In practice, it has been found that, for example, as much as half of all the cut material can remain behind on the bottom owing to spillage. This occurs in particular with hard soil types. The depth of the worked surface of the bottom obtained is then appreciably smaller than if a relatively large part or all the ground material had been sucked up. There is therefore a need for a cutter head which ensures that a larger proportion of the cut ground material than hitherto is indeed transported away and can be deposited in the bin of the cutter suction dredger by the suction device.

This object is achieved by the fact that non-return means extend between at least a pair of, preferably each pair of, neighboring arms, which non-return means prevent a movement of the cut material from the center axis of the cutter head to the outside. The non-return means as used in the cutter head according to the invention, on the one hand, offer the possibility of the cut material accessing the interior of the cutter head as usual. This movement is assisted by designing the arms in the shape of a helix, which is known per se, in order to cause the cut ground material to be conveyed into the interior upon rotation of the cutter head.

However, as soon as the ground material tries to move to the exterior, on account of any circumstances, for example on account of the force of gravity or of the abovementioned centrifugal forces resulting from the rotation of the cutter head, the non-return means become operational. In such cases, the latter block the openings between the arms of the cutter head, as a result of which the cut ground material is prevented from moving back to the exterior from the interior of the cutter head. As soon as this movement has been counteracted, the non-return means can open again and allow new cut ground material in.

This action of the non-return means can also be assisted by the associated sucking action of the suction device. The suction device causes a flow which is directed from the exterior to the interior, as a result of which the non-return means are already forced into the open position.

The non-return means which are suitable for use in the cutter head according to the invention can be designed in various different ways. According to a first option, the arms are provided with panels which are on the side which is remote from the teeth of each arm the non-return means then being attached to these panels. With such an embodiment, the non-return means, in the closed position, abut the panel of the opposite arm. On account of the centrifugal forces, or other forces which attempt to generate a flow to the exterior, these non-return means, in the closed position, are pressed firmly against the respective opposite panel. Thus, it is possible to reliably prevent already cut ground material, which is inside the interior of the cutter head, from emerging to the exterior.

In particular, the non-return means may be attached to a surface of an arm or panel, which surface is turned radially outwards with respect to the center axis, and are displaceable between a position where they interact with and a position where they do not interact with a surface of a neighboring arm or panel, which surface is turned radially inwards with respect to the center axis.

Incidentally, the non-return means do not necessarily have to provide a complete sealing. It is, for example, possible to provide the non-return means only in those positions where the potential loss of cut ground material is greatest. This mainly takes place at a relatively great distance from the rotary center axis of the cutter head, that is to say near the base ring, where the diameter of the cutter head is greatest. In this connection, provision may be made for the non-return means to be located only on the section of each arm which is adjacent to the base ring.

The design of the non-return means itself may also have many different forms. According to a first option, the non-return means may comprise flexible elements, for example made of rubber. However, according to a second option, the non-return means may also comprise rigid valves which are hingedly attached to an associated arm or panel. The base ring may be annular in the usual manner, while the core may comprise a hollow space turned towards the base ring. Furthermore, the non-return means may comprise spherical valves in a cage.

An important advantage of the cutter head according to the invention is that it cannot only be produced by fitting the non-return means during manufacturing of the cutter head, but also by fitting them afterwards. This means that existing cutter heads can be improved in a relatively simple manner by fitting the non-return means thereon.

The invention also relates to a cutter suction dredger which comprises a suction device provided with a suction tube which can be positioned in the body of water directed downwards at an angle, as well as a cutter head provided at the free end of the suction tube as described above and comprising a base ring, a core located at a distance from the base ring in the direction of the center axis, as well as a plurality of arms which extend from the base ring to the core, each of which arms has a series of teeth which are distributed at regular intervals between the base ring and the core, located on the radially outermost parts of the arm and directed outwards at an angle with respect to the peripheral direction, the direction of rotation of the cutter head being set in such a manner that the teeth perform a cutting movement.

According to the invention, it is provided that non-return means extend between at least two neighboring arms, which non-return means effectively prevent a movement of the cut material from the center axis to the exterior.

The invention furthermore relates to a method for removing material from the bottom of a body of water by means of a cutter suction dredger, comprising the steps of:

- providing a cutter suction dredger provided with a suction device having a cutter head as described above,
- cutting loose or loosening the ground material by rotating the cutter head,
- producing a sucking action in the suction device in order to create a flow of water and cut ground material from the interior of the suction head and via the openings between the arms of the suction head,
- at least partially closing the openings between the arms of the suction head by the non-return means when a flow in the opposite direction occurs.

The invention will now be explained with reference to an exemplary embodiment illustrated in the figures.

Figure 1:
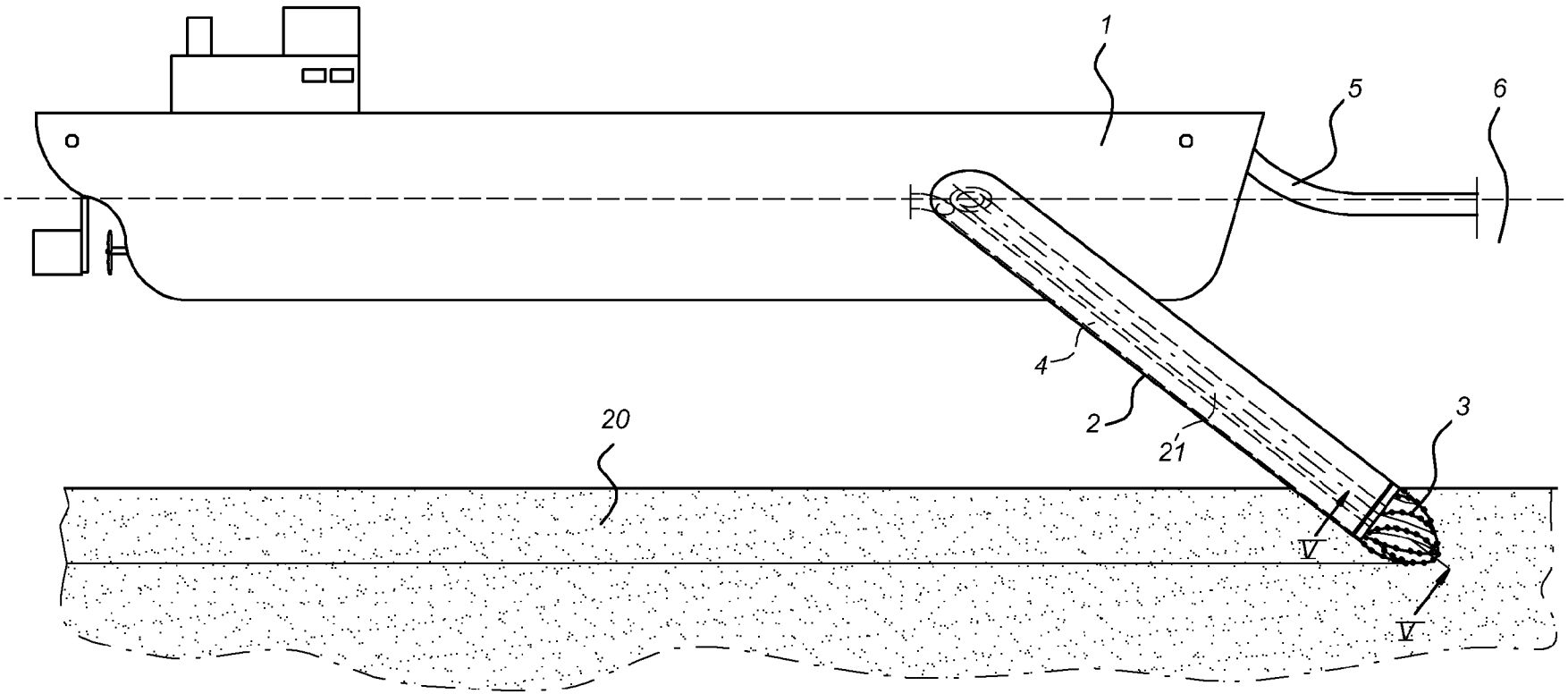
FIG. 1 shows a cutter suction dredger in operation.

The cutter suction dredger illustrated in FIG. 1 comprises a vessel 1, to which a ladder 2 is attached, at the free end of which a cutter head 3 is rotatably mounted. The suction tube 4, illustrated by broken lines, and drive shaft 21 extend through the ladder 2, which suction tube 4 is connected to a discharge line 5. Furthermore, the cutter suction dredger 1 comprises pumps, pipes and the like in a known manner in order to generate a flow through the suction tube 4, as well as drive means for driving the cutter head 3 in the direction of rotation. These installations are known per se, and will therefore not be described in any more detail.

The cutter suction dredger is situated in a body of water 6, the bottom 20 of which is being worked by the cutter head 3 in order to cut loose and remove ground material. These operations are likewise known per se and can be carried out for a large number of different purposes, such as, for example, deepening a waterway, extracting raw materials, removing contaminated material and the like.

The ground material cut loose by the cutter head 3 has to be removed as much as possible by means of the suction tube 4 without a lot of spillage occurring. After all, spillage means that the bottom 20 will become relatively less deep with the same amount of effort, which leads to a reduction in the efficiency of the operations. In this connection, the invention proposes a cutter head 3 which can ensure a better yield with respect to the removed ground material.

Figure 2:
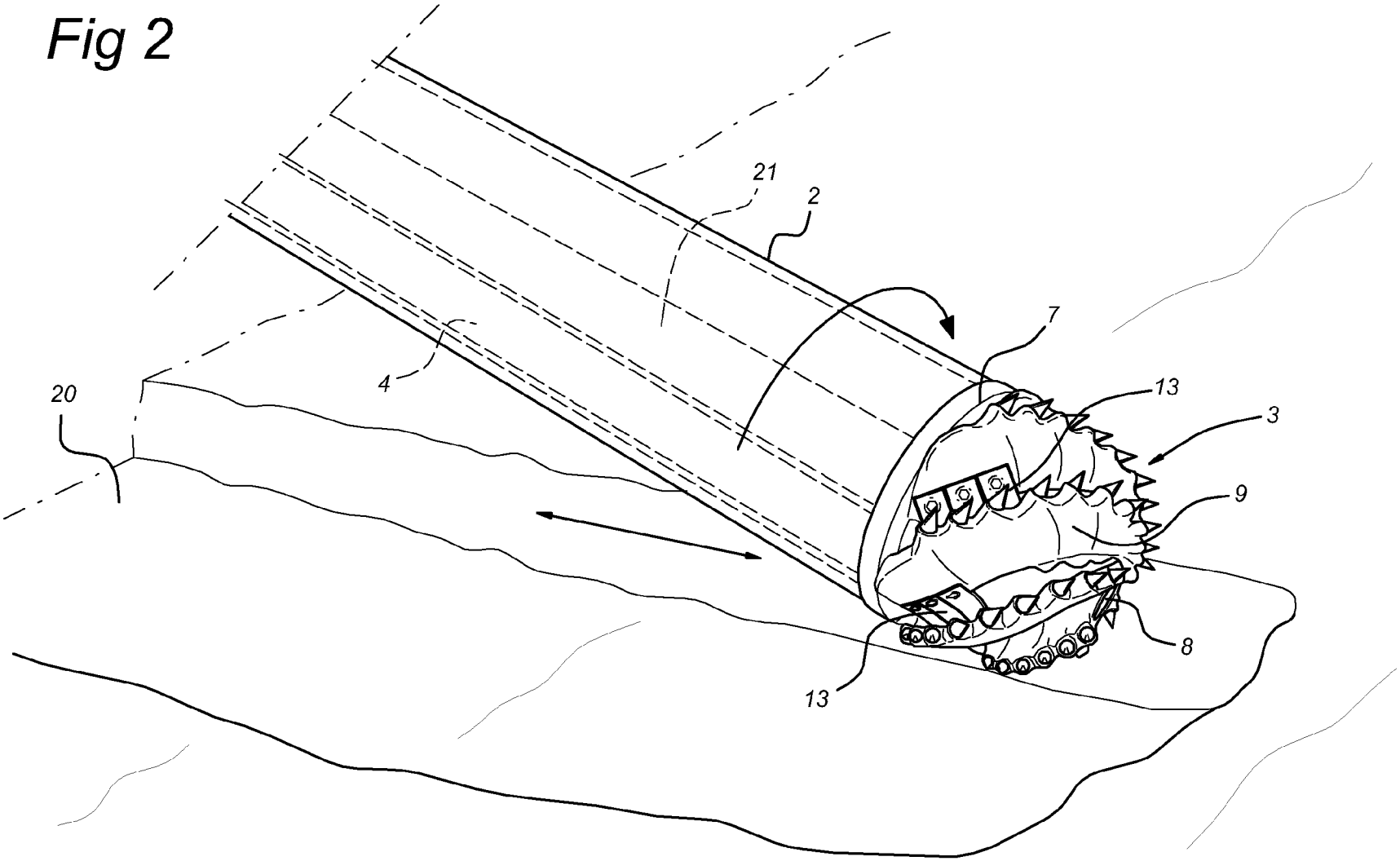
FIG. 2 shows an enlarged detail with the cutter head.
Figure 3:
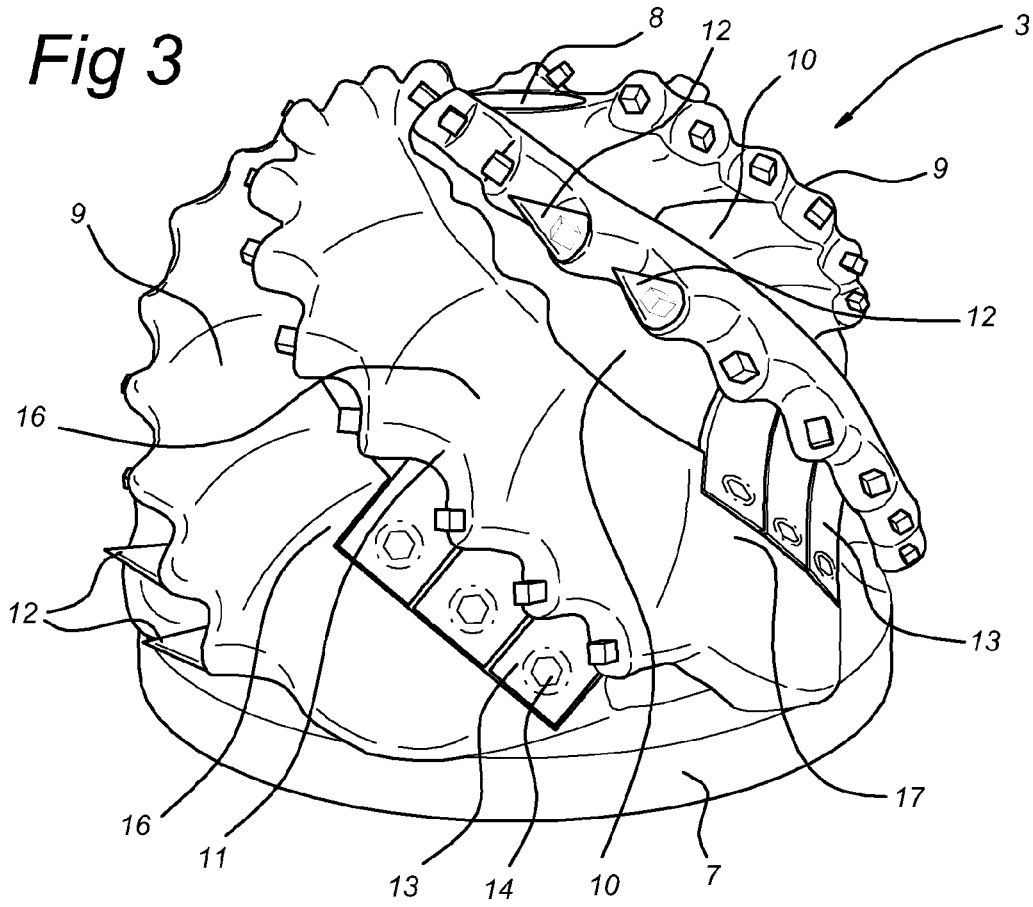
FIG. 3 shows a perspective view of the cutter head.
Figure 4:
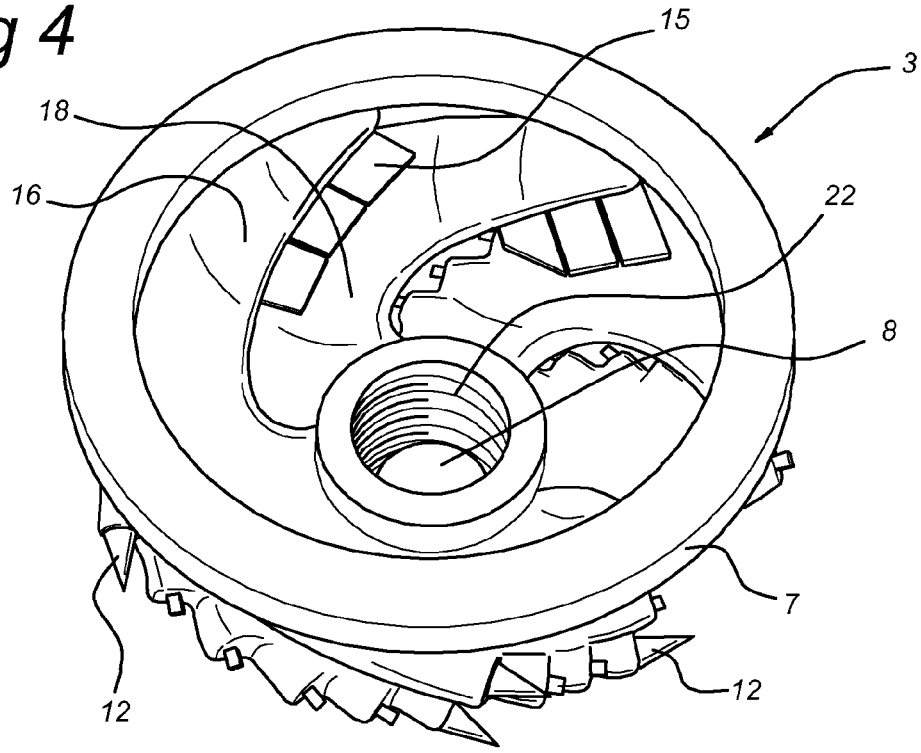
FIG. 4 shows a perspective view of the interior of the cutter head.

In FIGS. 2-4, this cutter head 3 is illustrated in an enlarged and more detailed manner. This cutter head 3 has, in a known manner, an annular base ring 7, as well as an open or closed boss 8 located at a distance from the base ring 7 in the longitudinal direction and between which arms 9 extend distributed at regular intervals in the peripheral direction of the base ring 7. These arms 9 extend helically and are curved convexly to the exterior due to the difference in diameter between the base ring 7 and the boss 8. As can be seen in FIG. 3, the arms 9 are attached to the base ring 7 at an acute angle and do not run tangentially with respect to the base ring 7 there, but turned outwards at a slight angle. The boss 8 is provided with an internal screw thread 22 for the attachment of the cutter head to the drive shaft 21.

A series of adapters 12 is in each case arranged on the radially outermost convexly curved edge 11 of the arms 9, which adapters are able to carry out a cutting action on the ground material in order to cut it loose. The teeth (not shown) are usually removably fitted to the adapters 12 on the cutter head 3 in such a way that they can be replaced once a certain degree of wear has occurred. Longitudinal slots or openings 10 are provided between the arms 9, via which slots or openings 10 the cut ground material can enter the interior of the cutter head 3. This is stimulated by the helical shape of the arms 9, as well as by the slightly oblique, that is to say non-tangential, orientation relative to the base ring 7.

Such a cutter head 3 is known per se, and may suffer from the problem that the ground material which has entered the interior of the cutter head 3 in some cases flows out of the latter. This may be due to the angular orientation of the cutter head, but may also be due to the centrifugal forces which occur during rotation of the cutter head 3. It is possible to prevent cut ground material received in the interior of the cutter head 3 from flowing out by means of non-return valves or non-return flaps 13. These non-return flaps 13 are, on the one hand, attached to an arm 9, in particular to the panels 16 thereof, at the location of an attachment part 14, while, on the other hand, their free end 15 may abut a neighboring arm 9 or the panel 16 thereof, as illustrated in the view of FIG. 4.

As is illustrated in FIG. 3, the non-return valves 13 are attached to the surface 17 turned radially outwards of the arms 9 and, in the closed position, come to lie against the surface 18 turned radially inwards of a neighboring arm. In the embodiment illustrated, non-return valves 13 are situated between each pair of neighboring arms 9, but this is not imperative. It is also possible for pairs of neighboring arms without valves to be present.

In the closed position of the non-return valves 13, the latter make that ground material which is contained in the interior of the cutter head 3 not just flows out or make it more difficult. On account of such a displacement, the non-return valves 13 will, after all, be closed, leading to ground material of this type being forced to remain inside the interior of the cutter head 3, in such a manner that this can then be sucked out. On the other hand, on account of the ground material and water flowing in, as a result of the suction device, each valve 13 can easily be kept in a pushed-open position, in such a manner that the normal operation of the cutter head 3 is not affected.

As is illustrated in FIGS. 3 and 4, the valves 13 do not have to extend over the entire length of the arms 9, although this is, of course, possible. In the variant illustrated, the valves 13 are only near that section of the arms 9 which is adjacent to the base ring 7. That is where the greatest centrifugal forces occur, due to the large diameter of the cutter head 3 in that area. Positioning the valves 13 in that area is therefore most effective, so that it is also possible to find the right balance between, on the one hand, water and cut ground material flowing in and, on the other hand, blocking ground material flowing out.

Although a cutter head is described above, the arms or blades of which are at an angle, the invention also relates to a cutter head having arms or blades which are not at an angle.

Figure 5:
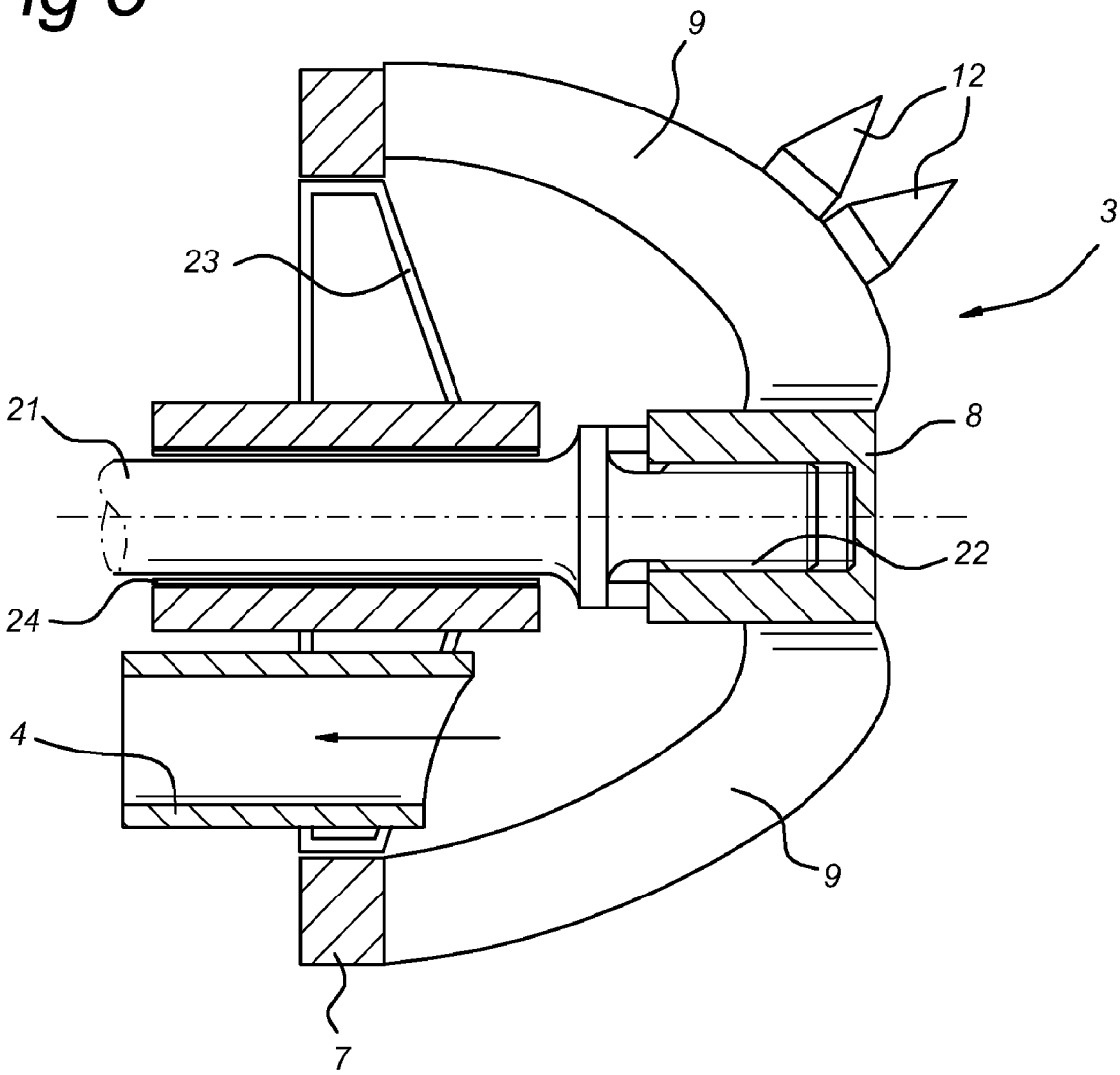
FIG. 5 shows a longitudinal section through the cutter head along line V-V from FIG. 1.

The longitudinal section in FIG. 5 shows the position of the cutter head 3, the drive shaft 21 and the suction tube 4 with respect to one another. The drive shaft 21 is screwed into the boss 8 and supported by the rod bearing 24. In addition, a shield 23 is present, which is situated inside the base 7 and connected to the suction tube 4.

The invention claimed is:

1. A cutter head for a cutter suction dredger intended to be mounted rotatably about a cutter head center axis with respect to a suction device for sucking up material which has been cut loose by the cutter head from the bottom of a body of water, which cutter head comprises a base ring, a boss located at a distance from the base ring in the direction of the center axis, as well as a plurality of arms which extend from the base ring to the boss and are distributed at regular intervals in the peripheral direction, each of which arms has a series of teeth located on radially outermost parts of the arm and directed outwards at an angle with respect to the peripheral direction, the direction of rotation of the cutter head being set in such a manner that the teeth perform a cutting movement, wherein non-return means extend between at least two neighboring arms, which non-return means prevent a movement of the cut material from the center axis to the exterior, wherein the non-return means are attached to a surface of an arm, which surface is turned radially outwards with respect to the center axis, and are displaceable between a position where they interact with and a position where they do not interact with a surface of a neighboring arm, which surface is turned radially inwards with respect to the center axis.

2. The cutter head as claimed in claim 1, wherein the transverse dimensions of the boss are smaller than those of the base ring.

3. The cutter head as claimed in claim 1, wherein the longitudinal axis of the section of each arm which is adjacent to the base ring is at an acute angle to the tangent of the base ring and the convexly curved side of each arm is turned away from the center axis.

4. The cutter head as claimed in claim 1, wherein panels are provided on the arms, which panels are on the side which is remote from the teeth of each arm, and the non-return means interact with these panels.

5. The cutter head as claimed in claim 1, wherein the non-return means are located on the section of each arm which is adjacent to the base ring.

6. The cutter head as claimed in claim 1, wherein the base ring is annular.

7. The cutter head as claimed in claim 1, wherein the boss comprises a hollow space turned towards the base ring.

8. A method for removing material from a bottom of a body of water by means of a cutter suction dredger, comprising the steps of:

providing a cutter suction dredger provided with a suction device having a cutter head as claimed in claim 1, cutting loose or loosening a ground material by rotating the cutter head, producing a sucking action in the suction device in order to create a flow of water and cut ground material from an interior of the cutter head and via openings between the arms of the cutter head, at least partially closing the openings between the arms of the cutter head by the non-return means when a flow in the opposite direction occurs.

9. A cutter head for a cutter suction dredger intended to be mounted rotatably about a cutter head center axis with respect to a suction device for sucking up material which has been cut loose by the cutter head from the bottom of a body of water, which cutter head comprises a base ring, a boss located at a distance from the base ring in the direction of the center axis, as well as a plurality of arms which extend from the base ring to the boss and are distributed at regular intervals in the peripheral direction, each of which arms has a series of teeth located on radially outermost parts of the arm and directed outwards at an angle with respect to the peripheral direction, the direction of rotation of the cutter head being set in such a manner that the teeth perform a cutting movement, wherein non-return means extend between at least two neighboring arms, which non-return means prevent a movement of the cut material from the center axis to the exterior, wherein the non-return means comprise flexible elements.

10. A cutter head for a cutter suction dredger intended to be mounted rotatably about a cutter head center axis with respect to a suction device for sucking up material which has been cut loose by the cutter head from the bottom of a body of water, which cutter head comprises a base ring, a boss located at a distance from the base ring in the direction of the center axis, as well as a plurality of arms which extend from the base ring to the boss and are distributed at regular intervals in the peripheral direction, each of which arms has a series of teeth located on radially outermost parts of the arm and directed outwards at an angle with respect to the peripheral direction, the direction of rotation of the cutter head being set in such a manner that the teeth perform a cutting movement, wherein non-return means extend between at least two neighboring arms, which non-return means prevent a movement of the cut material from the center axis to the exterior, wherein the non-return means comprise valves which are hingedly attached to an associated arm.

11. A cutter head for a cutter suction dredger intended to be mounted rotatably about a cutter head center axis with respect to a suction device for sucking up material which has been cut loose by the cutter head from the bottom of a body of water, which cutter head comprises a base ring, a boss located at a distance from the base ring in the direction of the center axis, as well as a plurality of arms which extend from the base ring to the boss and are distributed at regular intervals in the peripheral direction, each of which arms has a series of teeth located on radially outermost parts of the arm and directed outwards at an angle with respect to the peripheral direction, the direction of rotation of the cutter head being set in such a manner that the teeth perform a cutting movement, wherein non-return means extend between at least two neighboring arms, which non-return means prevent a movement of the cut material from the center axis to the exterior, wherein the non-return means comprise spherical valves, which are accommodated in a cage so as to be displaceable between an open and a closed position.

12. A cutter suction dredger, comprising a suction device provided with a suction tube which can be positioned in a body of water directed downwards at an angle, as well as a cutter head as claimed in claim 1 provided at the free end of the suction tube and comprising a base ring, a boss located at a distance from the base ring in the direction of the center axis, as well as a plurality of arms which extend from the base ring to the boss, each of which arms has a series of teeth located on the radially outermost parts of the arm and directed outwards at an angle with respect to the peripheral direction, the direction of rotation of the cutter head being set in such a manner that the teeth perform a cutting movement, wherein non-return means extend between at least two neighboring arms, which non-return means effectively prevent a movement of the cut material from the center axis to the exterior.

* * * * *